US005362367A

United States Patent [19]

Dapperheld et al.

[11] Patent Number: 5,362,367

[45] Date of Patent: Nov. 8, 1994

[54] PARTIAL ELECTROLYTIC DEHALOGENATION OF DICHLOROACETIC AND TRICHLOROACETIC ACID AND ELECTROLYSIS SOLUTION

[75] Inventors: Steffen Dapperheld, Hofheim am Taunus; Rudolf Rossmeissl, Mertingen, both of Germany

[73] Assignee: Hoechst Aktiengesellschaft, Frankfurt, Germany

[21] Appl. No.: 139,337

[22] Filed: Oct. 19, 1993

Related U.S. Application Data

[63] Continuation of Ser. No. 701,480, May 16, 1991, abandoned.

[30] Foreign Application Priority Data

May 18, 1990 [DE] Germany ..... 4016063

[51] Int. Cl.[5] ..... C25B 3/00

[52] U.S. Cl. ..... 204/72; 252/182.1; 252/518; 252/519; 564/291; 564/296; 204/81

[58] Field of Search ..... 204/59 R, 72, 128, 81, 204/73 R, 74, 78; 564/291, 296; 252/182.1, 500, 518, 519

[56] References Cited

U.S. PATENT DOCUMENTS

| | | | |
|---|---|---|---|
| 4,707,226 | 11/1987 | Dapperheld | 204/81 |
| 4,892,944 | 1/1990 | Mori et al. | 564/291 |
| 5,026,460 | 6/1991 | Dapperheld | 204/59 R |

FOREIGN PATENT DOCUMENTS

| | | | |
|---|---|---|---|
| 226275 | 6/1987 | European Pat. Off. . | |
| 334796 | 9/1989 | European Pat. Off. . | |
| 0241685 | 12/1989 | European Pat. Off. . | |
| 54-76521 | 6/1979 | Japan . | |
| 0024333 | 2/1982 | Japan | 564/291 |

OTHER PUBLICATIONS

Bockris et al., *Modern Electrochemistry,* "Electrified Interface"; p. 689; vol. 2, 1970, N.Y.

*Hack's Chemical Dictionary* "Surfactant"; p. 650; Fourth Edition, 1969.

Nekrasov, L. N. et al., Elektrokhimiya 24, No. 4:528–531 (1988) (English language version, translation of same journal, 24, 560–563 (1988).

*Primary Examiner*—Kathryn Gorgos

*Attorney, Agent, or Firm*—Connolly and Hutz

[57] ABSTRACT

Trichloroacetic and dichloroacetic acid are dehalogenated to give monochloroacetic acid by electrolyzing aqueous solutions of these acids in divided electrolysis cells using carbon cathodes; the aqueous electrolytic solutions also contain one or more metal salts having a hydrogen overvoltage of at least 0.4 volt (at a current density of at least 4000 $A/m^2$) and specific ammonium and/or phosphonium salts.

In this process, there is an extremely small evolution of hydrogen at the cathode, even at a very low concentration of the polychlorinated acetic acid, without the high selectivity of conversion of the electrolysis being impaired in continuous operation.

12 Claims, No Drawings

PARTIAL ELECTROLYTIC DEHALOGENATION OF DICHLOROACETIC AND TRICHLOROACETIC ACID AND ELECTROLYSIS SOLUTION

This is a continuation of Ser. No. 07/701,480, filed May 16, 1991, now abandoned.

BACKGROUND OF THE INVENTION

Monochloroacetic acid and its derivatives are important intermediates in industrial organic synthesis. They are used for the preparation of adhesives, plant protection agents and pharmaceutical products. The preparation of monochloroacetic acid by chlorinating acetic acid always involves the formation of dichloroacetic and trichloroacetic acid. As well as catalytic hydrogenation of dichloroacetic and trichloroacetic acid to give monochloroacetic acid, electrochemical dehalogenation is also available for the removal of dichloroacetic and trichloroacetic acid from the mixture of products (EP-B 0,241,685).

The last-mentioned dehalogenation is carried out using graphite cathodes in the presence of small amounts of metal salts having a hydrogen overvoltage of at least 0.4 volts (at a current density of 4000 amps/$m^2$), and is preferably carried out in aqueous acid electrolytes.

This process has a high selectivity of conversion, since, at low concentrations of the dichloroacetic and trichloroacetic acid to be partially dehalogenated, thermodynamically favored reduction of protons to hydrogen takes place at the cathode. Although an undesirable dehalogenation of the monochloroacetic acid is avoided in this manner, the dichloroacetic acid and the trichloroacetic acid are dehalogenated at only a poor current efficiency. This process is not suitable for dehalogenation down to a very low concentration level of dichloroacetic and trichloroacetic acid, since an increasingly larger fraction of the electrical charge is consumed for the reduction of protons to hydrogen. Dehalogenation to give monochloroacetic acid in an economical manner at a low concentration of dichloroacetic and trichloroacetic acid has, therefore, hitherto only been possible to an inadequate extent (comparison example).

It was, therefore, an object to dehalogenate dichloroacetic and trichloroacetic acid selectively; that is to say not completely—at a very high degree of conversion.

It is known then from EP-A 0,280,120 that complete dechlorination of 3,3-dichloro-2-fluoroacrylic acid takes place in the presence of protonated dimethylaniline, particularly if the dechlorination is carried out batchwise.

Nekrasov et al. have investigated the dehalogenation of trichloroacetic acid and monochloroacetic acid in the presence of a tetramethylammonium or tetraethylammonium salt in an aprotic electrolyte (Nekrasov et al., Elektrokhimiya 1988, 24, 560–563). The effects observed by them do not, however, indicate in any way that ammonium salts would be able to inhibit the above-mentioned undesirable reduction of protons to hydrogen in an aqueous electrolyte.

It has now been found, surprisingly, that it is possible to dehalogenate dichloroacetic and trichloroacetic acid to give monochloroacetic acid at a very high degree of conversion continuously or discontinuously in divided electrolytic cells, if electrolysis is carried out in aqueous solutions in which quaternary ammonium and/or phosphonium salts are dissolved, as well as metal salts having a hydrogen overvoltage of at least 0.4 volt (at a current density of 4000 A/$m^2$).

SUMMARY OF THE INVENTION

The invention relates, therefore, to a process for the partial dehalogenation of trichloroacetic and dichloroacetic acid to give monochloroacetic acid by the electrolysis of aqueous solutions of these acids in divided cells in the presence of one or more metal salts having a hydrogen overvoltage of at least 0.4 volt (at a current density of 4000 A/$m^2$), using carbon cathodes, which comprises adding at least one compound selected from the group consisting of compounds of the formula I to V

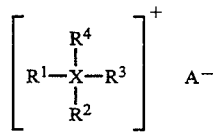
(I)

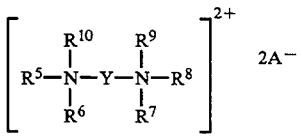
(II)

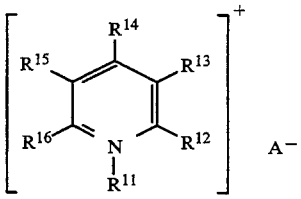
(III)

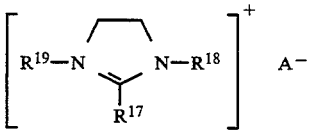
(IV)

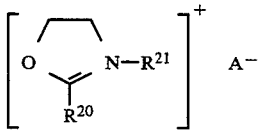
(V)

in which

X is nitrogen or phosphorus, $R^1$ to $R^{21}$ are identical or different and independently of one another are hydrogen, linear or branched $C_1$–$C_{18}$-alkyl, $C_3$–$C_{18}$-cycloalkyl or $C_1$–$C_{18}$-alkylaryl, the aryl radical having 6 to 12 carbon atoms and the radicals $R^2$ to $R^{16}$ being able, in addition, independently of one another to have the following meaning:

$R^2$ is a group of the formula $—((CH_2)_n—O)_m—R$ in which the same radicals are suitable for R as for $R^1$, but $R^1$ and R are independent of one another, n being an integer from 1 to 12 and m being also an integer from 1 to 12, $R^3$ and $R^4$ together, $R^5$ and $R^6$ together and/or $R^7$ and $R^8$ together are, independently of one another, a chain of 2 to 8 $CH_2$ groups or a group of the formula $—CH_2(Z)CH_2—$ in which Z is nitrogen, oxygen or sulfur, $R^{12}$ and $R^{13}$ together, $R^{13}$ and $R^{14}$ together, $R^{14}$ and $R^{15}$ together and/or $R^{15}$ and $R^{16}$ together are, independently of one another, a group of the formula

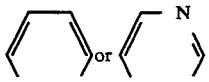

Y is a group of the formula $-(CH_2)_p-$ or $-CH_2-[O-(CH_2)_p]_q-O-(CH_2)_2-$ in which p is an integer from 1 to 12 and q is an integer from 0 to 6, and $A^-$ is one of the anions $OH^-$, $F^-$, $Cl^-$, $Br^-$, $I^-$, $SO_4^{2-}$, $HSO_4^-$, $NO_3^-$, $CH_3COO^-$, $BF_4^-$ or $CH_3OSO_3^-$.

The invention also relates to an electrolysis solution for the partial dehalogenation of di- and/or trichloroacetic acid which contains at least one of said acids and one or more metal salts having a hydrogen overvoltage of at least 0.4 volt (at a current density of at least 4000 $A/m^2$) and also at least one compound selected from the group composed of the compounds of the formula I to V.

Preferred compounds of the formula I are those in which $R^1$ to $R^4$ independently of one another are hydrogen or $C_1$–$C_{16}$-alkyl, and also compounds of the formula III in which $R^{11}$ is $C_4$–$C_{16}$-alkyl and $R^{12}$ to $R^{16}$ independently of one another are H or $C_4$–$C_{18}$-alkyl.

Compounds of the formula II in which $R^5$ to $R^{10}$ independently of one another are $C_4$–$C_6$-alkyl, cyclohexyl and linear and even-numbered $C_8$–$C_{16}$-alkyl are also preferred.

Particularly preferred compounds are

A) compounds of the formula I in which X is nitrogen or phosphorus, $R^1$ is $C_1$–$C_3$-alkyl and $R^2$ to $R^4$ independently of one another are $C_1$–$C_4$-alkyl, and B) compounds of the formula III in which $R^{11}$ is $C_8$–$C_{16}$-alkyl and $R^{12}$ to $R^{16}$ are H.

At least one compound of the formula I or II or III or IV or V or any desired mixtures of compounds of the formulae I, II, III, IV and V are employed in the electrolysis in the process according to the invention.

The compounds of the formulae I to V are used in concentrations of 1 to 5000 ppm, preferably 10 to 1000 ppm and particularly 50 to 500 ppm.

The metal salts having a hydrogen overvoltage of at least 0.4 volt (at a current density of 4000 $A/m^2$) employed are, in general, the soluble salts of Cu, Zn, Cd, Hg, Sn, Pb, Ti, Bi, V, Ta and/or Ni, preferably the soluble salts of Cu, Zn, Cd, Sn, Hg and Pb. The anions preferably used are $Cl^-$, $Br^-$, $SO_4^{2-}$, $NO_3^-$ or $CH_3COO^-$, the anion being so selected that a soluble metal salt is formed (for example $PbNO_3$).

The salts can be added to the electrolysis solution without further treatment or can be generated in the solution, for example by adding oxides or carbonates or by adding the metals themselves, such as Zn, Cd, Sn, Pb or Ni.

The salt concentration in the catholyte is advantageously adjusted to about 0.1 to 5000 ppm, preferably about 10 to 1000 ppm.

In general, in the process according to the invention, an extremely small evolution of hydrogen at the cathode takes place, even at very low concentrations of the polychlorinated acetic acids, without the high selectivity of conversion of the electrolysis being impaired in continuous working. The process according to the invention is, therefore, extremely economical, which could not in any way have been expected from the state of the art. Even a continuous procedure at low concentrations of the starting compounds results only to a small extent in acetic acid.

The starting material used for the process is dichloroacetic and/or trichloroacetic acid or mixtures thereof, formed unavoidably in the chlorination of acetic acid, with monochloroacetic acid.

In general, aqueous solutions of the chlorinated acetic acids can be used, in particular as the catholyte, in all possible concentrations (approx. 1 to approx. 95 % by weight).

It is particularly advantageous if the proportion by weight of the dichloroacetic and trichloroacetic acid to the total amount of chlorinated acetic acids is less than 10% by weight. In this regard, this proportion by weight can easily be less than 5% by weight, or even less than 2% by weight, which was extremely surprising. The catholyte can, in addition, also contain mineral acids (for example HCl, $H_2SO_4$ etc.).

The anolyte is preferably an aqueous mineral acid, in particular aqueous hydrochloric acid or sulfuric acid.

In principle, any customary carbon electrode material such as, for example, graphite electrodes, impregnated graphite materials or glass-like carbon, is suitable for use as the carbon cathode.

The anode material used can generally be the same material as for the cathode. In addition, it is also possible to employ other customary electrode materials, which must, however, be inert under the conditions of electrolysis, for example titanium coated with titanium dioxide and doped with a noble metal oxide, such as, for example, ruthenium dioxide.

In general, cation exchange membranes composed of perfluorinated polymers having carboxylic and/or sulfonic acid groups are used for dividing the cells into an anode space and a cathode space. The use of anion exchange membranes stable in the electrolyte, or diaphragms composed of polymers or inorganic materials is also generally possible. The temperature of electrolysis should generally be below 100° C., preferably between 10° and 90° C.

The electrolysis can be carried out either continuously or discontinuously. A continuous process is preferred, above all at a low concentration of the dichloroacetic and trichloroacetic acid.

If aqueous hydrochloric acid is used as the anolyte, chloride is then consumed continuously as a result of the evolution of chlorine at the anode. The chloride consumption is then generally replenished by continuously introducing gaseous HCl or aqueous hydrochloric acid.

The working up of the product of electrolysis is effected in a known manner, for example by distillation. The metal salts and the quaternary ammoniun and phosphonium compounds then remain in the residue and can be recycled back to the process.

The invention will now be further illustrated by the following examples. A comparison example follows after Examples 1–9. It can be seen from the comparison example that, under the conditions of electrolysis of EP-B 0,241,685, the bulk of the electric charge is consumed in the reduction of protons to hydrogen, as soon as a dichloroacetic acid concentration of 31% (relative to the total amount of dissolved acetic acids) is reached.

EXAMPLES 1 TO 8

Electrolysis conditions

Circulating cell with an electrode surface area of 0.0015 $m^2$;

Interelectrode distance 5 mm

Electrodes: ®Diabon (Sigri, Meitingen, Germany) impregnated graphite

Cation exchange membrane: ®Nafion 324 (DuPont, Wilmington, Del., USA, 2-layer membrane composed of copolymers formed from perfluorosulfonylethoxy vinyl ether and tetrafluoroethylene. On the cathode side, there is a layer with an equivalent weight of 1300 and on the anode side a layer with an equivalent weight of 1100)

Spacing piece: polyethylene nets

Flow rate: 100 l/hour

Temperature: 30°–42° C.

Anolyte: concentrated hydrochloric acid, replenished continuously by gaseous HCl Catholyte: 800 g of water, 350 g of monochloroacetic acid and 7 g of dichloroacetic acid (in Example 2 trichloroacetic acid). The dichloroacetic or trichloroacetic acid is fed to the catholyte in constant amounts at intervals of approx. 10 minutes until the amount indicated in the table has been reached. The concentrations of the metal salt and of the particular compound of the formula I or III employed can be seen from the table.

EXAMPLE 9

Electrolysis cell as in 1, but with the following changes:

Electrode surface area: 0.02 $m^2$

Cation exchange membrane: ®Nafion 423 (DuPont, 1-layer membrane composed of polymers formed from perfluorosulfonylethoxy vinyl ether and tetrafluoroethylene and having an equivalent weight of 1200)

Flow rate: 400 l/hour

Catholyte: 2400 g of water, 1050 g of monochloroacetic acid and 60 g of dichloroacetic acid. The concentrations of the metal salt and of the compound of the formula I can be seen from the table.

COMPARISON EXAMPLE

Electrolysis as in EP-B 0,241,685

Electrolysis conditions as in Examples 1 to 8, with the following exceptions:

Catholyte: 2 kg of water, 0.4 kg of dichloroacetic acid and 532 ppm of $CdCl_2$

Current density: 4000 A/$m^2$

Cell voltage: 4.5 volts

Electricity consumed: 145 Ah

Result of electrolysis:

Dichloroacetic acid: 0.1 kg (=31.1% by weight)

Monochloroacetic acid: 0.221 kg (=68.9% by weight).

An amount of 36% of the electricity was consumed in the reduction of protons to hydrogen during the electrolysis. The economy of the process according to the invention becomes particularly clear when the comparison example and Example 6 are contrasted. In Example 6, the proportion of the electrical charge consumed for the reduction of protons to hydrogen is only 2.1%, at a dichloroacetic acid content of 1% by weight.

Examples 1–9

| Example | Metal salt (ppm) | Compounds of the formula I or III (ppm) | Current density [A/$m^2$] | Voltage [volts] | Electricity consumed [Ah] |
|---|---|---|---|---|---|
| 1 | $Pb(OOCCH_3)_2.2H_2O$ (217) | Methyltri-n-octylammonium chloride (434) | 2000 | 6.0 | 36.7 |
| 2 | $Pb(OOCCH_3)_2.2H_2O$ (173) | Methyltri-n-octylammonium chloride (344) | 5000 | 8.2 | 81.2 |
| 3 | $Pb(OOCCH_3)_2.2H_2O$ (87) | Tri-n-butylmethylammonium chloride (434) | 2000 | 5.4 | 57.5 |
| 4 | $CuSO_4.H_2O$ (52) | Tetramethylammonium chloride (206) | 2000 | 4.8 | 32.6 |
| 5 | $ZnCl_2$ (87) | Tetra-n-butylmethylphosphonium bromide (434) | 2000 | 5.0 | 39.8 |
| 6 | $CdSO_4$ (87) | Tri-n-butylmethylammonium chloride (150) | 2000 | 4.6 | 32.4 |
| 7 | $SnCl_2$ (87) | n-Hexyltrimethylammonium chloride (173) | 2000 | 5.5 | 27.4 |
| 8 | $Hg(OOCCH_3)_2$ (54) | (N)-n-Hexadecylpyridinium chloride (434) | 2000 | 5.8 | 16.0 |
| 9 | $Pb(OOCCH3)_2.2H_2O$ (30) | Tri-n-butylmethylammonium chloride (134) | 2000 | 5.0 | 1326.0 |

| Example | Metal salt (ppm) | Dichloroacetic acid added 1) in portions of [g/10 min] | total amount [g] | Proportion of electricity consumed for the evolution of $H_2$, relative to the total amount of electricity consumed [%] | Acetic acid content [% by weight] | Monochloroacetic acid content [% by weight] | Dichloroacetic acid content [% by weight] |
|---|---|---|---|---|---|---|---|
| 1 | $Pb(OOCCH_3)_2.2H_2O$ (217) | 0.53 | 38.5 | 0.6 | 2.5 | 96.7 | — |
| 2 | $Pb(OOCCH_3)_2.2H_2O$ (173) | 1.24 | 122.5 | 0.1 | 1.6 | 94.3 | 4.1 |
| 3 | $Pb(OOCCH_3)_2.2H_2O$ (87) | 0.45 | 51.0 | 4.4 | 3.6 | 95.4 | 1.0 |
| 4 | $CuSO_4.H_2O$ (52) | 0.75 | 48.8 | 18.4 | 0.5 | 97.8 | 1.7 |
| 5 | $ZnCl_2$ (87) | 0.71 | 56.7 | 19.5 | 2.0 | 95.2 | 2.8 |
| 6 | $CdSO_4$ (87) | 0.97 | 63.0 | 2.1 | 0.6 | 98.4 | 1.0 |
| 7 | $SnCl_2$ (87) | 0.70 | 38.0 | 24.1 | 1.6 | 95.8 | 2.6 |
| 8 | $Hg(OOCCH_3)_2$ (54) | 0.75 | 24.0 | 26.1 | 1.6 | 95.2 | 3.2 |
| 9 | $Pb(OOCCH3)_2.2H_2O$ (30) | 8.40 | 1677.0 | 22.4 | 3.9 | 94.1 | 2.0 |

1) In Example 2: trichloroacetic acid

We claim:

1. A process for the partial dehalogenation of trichloroacetic and dichloroacetic acids to give monochloroacetic acid by the electrolysis of aqueous solutions of these acids in divided cells with one or more metal salts having a hydrogen overvoltage of at least 0.4 volts measured at a current density of 4000 A/$m^2$, using carbon cathodes, which comprises adding at least one compound selected from the group consisting of compounds of the formula I to V (I)

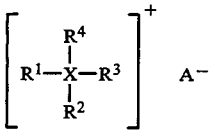

(II)

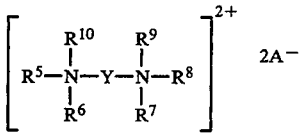

(III)

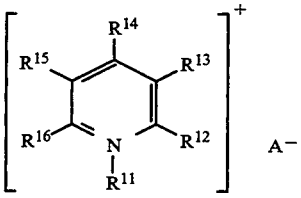

(IV)

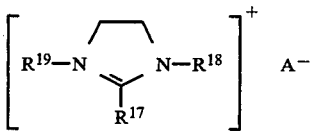

(V)

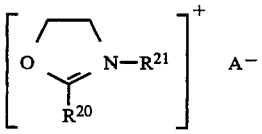

in which

X is nitrogen or phosphorus, $R^1$ to $R^{21}$ are identical or different and independently of one another are hydrogen, linear or branched $C_1$–$C_{18}$-alkyl, $C_3$–$C_{18}$-cycloalkyl or $C_1$–$C_{18}$-alkylaryl, the aryl radical having 6 to 12 carbon atoms and the radicals $R^2$ to $R^{16}$ in addition, independently of one another having the following meaning:

$R^2$ is a group of the formula $—((CH_2)_n—O)_m—R$ in which the same radicals are used for R as for $R^1$, but $R^1$ and R are independent of one another, n being an integer from 1 to 12 and m being also an integer from 1 to 12, $R^3$ and $R^4$ together, $R^5$ and $R^6$ together or $R^7$ and $R^8$ together are, independently of one another, a chain of 2 to 8 $CH_2$ groups or a group of the formula $—CH_2(Z)CH_2—$ in which Z is nitrogen, oxygen or sulfur, $R^{12}$ and $R^{13}$ together, $R^{13}$ and $R^{14}$ together, $R^{14}$ and $R^{15}$ together or $R^{15}$ and $R^{16}$ together are, independently of one another, a group of the formula

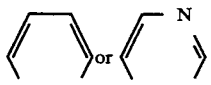

Y is a group of the formula $(—CH_2)_p—$ or $—CH_2—(O—(CH_2)_p)_q—O—(CH_2)_2—$ in which p is an integer from 1 to 12 and q is an integer from 0 to 6, and $A^-$ is one of the anions $OH^-$, $F^-$, $Cl^-$, $Br^-$, $I^-$, $SO_4^{2-}$, $HSO_4^-$, $NO_3^-$, $CH_3COO^-$, $BF_4^-$ or $CH_3OSO_3^-$.

2. The process as claimed in claim 1, wherein, in formula I, $R^1$ to $R^4$ independently of one another are hydrogen or $C_1$–$C_{16}$-alkyl.

3. The process as claimed in claim 1, wherein, in formula I, X is nitrogen or phosphorus, $R^1$ is $C_1$–$C_3$-alkyl and $R^2$ to $R^4$ independently of one another are $C_1$–$C_4$-alkyl.

4. The process as claimed in claim 1, wherein the soluble salts of Cu, Zn, Cd, Hg, Sn, Pb, Ti, Bi, V, Ta or Ni or a mixture thereof, are used as the metal salts having a hydrogen overvoltage of at least 0.4 volts measured at a current density of 4000 $A/m^2$.

5. The process as claimed in claim 1, wherein at least 94.1% by weight of monochloroacetic acid is formed.

6. The process as claimed in claim 1, wherein the proportion of electricity consumed for the evolution of $H_2$, relative to the total amount of electricity consumed, is 2.1% or less.

7. A process for the partial dehalogenation of trichloroacetic and dichloroacetic acids to give monochloroacetic acid by the electrolysis of aqueous solutions of these acids in divided cells in with one or more metal salts having a hydrogen overvoltage of at least 0.4 volts at a current density of 4000 $A/m^2$, using carbon cathodes, which comprises adding at least one compound of the formula I (I)

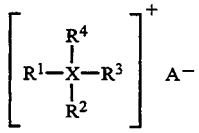

in which

X is nitrogen or phosphorus, $R^1$ to $R^4$ are identical or different and independently of one another are hydrogen, linear or branched $C_1$–$C_{18}$-alkyl, $C_3$–$C_{18}$-cycloalkyl or $C_1$–$C_{18}$-alkylaryl, the aryl radical having 6 to 12 carbon atoms and the radicals $R^2$ to $R^4$ in addition, independently of one another having the following meaning:

$R^2$ is a group of the formula $—((CH_2)_n—O)_m—R$ in which the same radicals are used for R as for $R^1$, but $R^1$ and R are independent of one another, n being an integer from 1 to 12 and m being also an integer from 1 to 12, $R^3$ and $R^4$ together are a chain of 2 to 8 $CH_2$ groups or a group of the formula $—CH_2(Z)CH_2—$ in which Z is nitrogen, oxygen or sulfur and $A^-$ is one of the anions $OH^-$, $F^-$, $Cl^-$, $Br^{13}$, $I^-$, $SO_4^{2-}$, $HSO_4^-$, $NO_3^-$, $CH_3COO^-$, $BF_4^-$ or $CH_3OSO_3^-$.

8. The process as claimed in claim 7, wherein, in formula I, $R^1$to $R^4$ independently of one another are hydrogen or $C_1$–$C_{16}$-alkyl.

9. The process as claimed in claim 7, wherein, in formula I, X is nitrogen or phosphorus, $R^1$ is $C_1$–$C_3$-alkyl and $R^2$ to $R^4$ independently of one another are $C_1$–$C_4$-alkyl.

10. The process as claimed in claim 7, wherein the soluble salts of Cu, Zn, Cd, Hg, Sn, Pb, Ti, Bi, V, Ta or Ni or a mixture thereof, are used as the metal salts having a hydrogen overvoltage of at least 0.4 volts measured at a current density of 4000 $A/m^2$.

11. An electrolytic solution for the partial dehalogenation of trichloroacetic or dichloroacetic acids or mixtures thereof, which comprises at least one of said acids and one or more metal salts having a hydrogen overvoltage of at least 0.4 volts measured at a current density of 4000 A/m$^2$ and also at least one compound selected from the group consisting of the compounds of the formula I to V (I)

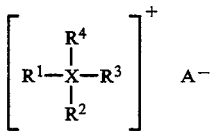

(II)

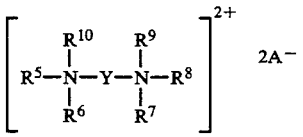

(III)

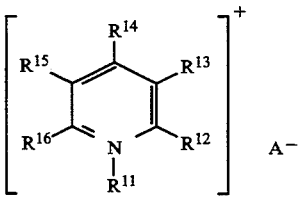

(IV)

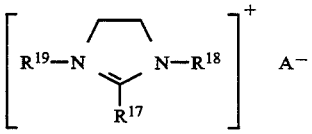

-continued (V)

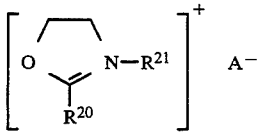

in which:

X is nitrogen or phosphorus, $R^1$ to $R^{21}$ are identical or different and independently of one another are hydrogen, linear or branched $C_1$–$C_{18}$-alkyl, $C_3$–$C_{18}$-cycloalkyl or $C_1$–$C_{18}$-alkylaryl, the aryl radical having 6 to 12 carbon atoms and the radicals $R^2$ to $R^{16}$, in addition, independently of one another having the following meaning:

$R^2$ is a group of the formula $—((CH_2)_n—O)_m—R$ in which the same radicals are used for R as for $R^1$, but $R^1$ and R are independent of one another, n being an integer from 1 to 12 and m being aim an integer from 1 to 12, $R^3$ and $R^4$ together, $R^5$ and $R^6$ together or $R^7$ and $R^8$ together are, independently of one another a chain of 2 to 8 $CH_2$ groups or a group of the formula $—CH_2(Z)CH_2—$ in which Z is nitrogen, oxygen or sulfur, $R^{12}$ and $R^{13}$ together, $R^{13}$ and $R^{14}$ together, $R^{14}$ and $R^{15}$ together or $R^{15}$ and $R^{16}$ together are, independently of one another a group of the formula

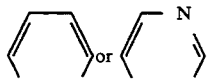

Y is a group of the formula $—(CH_2)_p—$ or $—CH_2—(O—(CH_2)_p)_q—O—(CH_2)_2—$ in which p is an integer from 1 to 12 and q is an integer from 0 to 6, and $A^-$ is one of the anions $OH^-$, $F^-$, $Cl^-$, $Br^-$, $I^{13}$, $SO_4^{2-}$, $HSO_4^-$, $NO_3^{13}$, $CH_3COO^-$, $BF_4^-$ or $CH_3OSO_3^-$.

12. An electrolytic solution as claimed in claim 11 in which the soluble salts of Cu, Zn, Cd, Hg, Sn, Pb, Ti, Bi, V, Ta or Ni or mixtures thereof, are employed as the metal salts having a hydrogen overvoltage of at least 0.4 volts measured at a current density of 4000 A/m$^2$.

* * * * *